US005205755A

United States Patent [19]

Douty et al.

[11] Patent Number: 5,205,755

[45] Date of Patent: Apr. 27, 1993

[54] FLOAT MOUNT ELECTRICAL CONNECTOR

[75] Inventors: George H. Douty, Mifflintown; David J. Fabian, Mount Joy; John M. Landis, Camp Hill, all of Pa.

[73] Assignee: AMP Incorporated, Harrisburg, Pa.

[21] Appl. No.: 860,951

[22] Filed: Mar. 31, 1992

[51] Int. Cl.[5] ..... H01R 13/74

[52] U.S. Cl. ..... 439/247; 439/563; 439/565; 248/27.1

[58] Field of Search ..... 439/247, 248, 534, 563, 439/564, 565, 570, 252; 248/27.1

[56] References Cited

U.S. PATENT DOCUMENTS

| | | | |
|---|---|---|---|
| 2,438,371 | 3/1948 | Marholz | 439/247 |
| 3,883,209 | 5/1975 | Kongelbeck | 439/248 |
| 3,951,500 | 3/1976 | Anderson | 439/248 |
| 4,352,538 | 10/1982 | Fowler | 439/404 |
| 4,664,456 | 5/1987 | Blair et al. | 439/108 |
| 4,761,144 | 8/1988 | Hunt, III et al. | 439/545 |
| 4,812,133 | 3/1989 | Fleak et al. | 439/248 |
| 4,909,748 | 3/1990 | Kozono et al. | 439/247 |
| 5,017,151 | 5/1991 | Peterson | 439/248 |
| 5,105,339 | 4/1992 | Olsson et al. | 439/565 |

FOREIGN PATENT DOCUMENTS

| | | | |
|---|---|---|---|
| 1285540 | 1/1987 | U.S.S.R. | 248/27.1 |
| 1343481 | 10/1987 | U.S.S.R. | 439/247 |
| 1009179 | 11/1965 | United Kingdom | 439/563 |

*Primary Examiner*—Gary F. Paumen
*Attorney, Agent, or Firm*—David L. Smith

[57] ABSTRACT

Electrical connector (2) is mounted in a cut out (65) in a mounting panel (66) by means of a pair of straps (82) which are secured to the rear face of the panel by means of bolts (84) the connector (2) has opposite coplanar flanges (22). The straps (82) have portions (92) which project away from the panel (66). The flanges (22) of the connector (2) are slideably received between the inner faces (94) of the straps (82) and are also spaced from the ends of the straps so that the connector is capable of both up and down and tilting movement with respect to the panel (66).

11 Claims, 8 Drawing Sheets

FLOAT MOUNT ELECTRICAL CONNECTOR

BACKGROUND OF THE INVENTION

This relates to mounting an electrical connector in a cut out in a panel, and in particular to providing a connector for mounting in a panel cut out to a kit of parts for float mounting an electrical connector in a cut out in a panel. The invention particularly concerns the float mounting of an electrical connector in a back panel of a rack mounted drawer containing a module for distributing electrical power to a computer, for example. Such a connector must necessarily be float mounted if it is to mate with a power supply connector which is rigidly mounted to a casing in the rack, despite misalignment of the two connectors.

There is disclosed in U.S. Pat. No. 3,951,500, an electrical connector which is float mounted to a support element by means of a spring or springs surrounding the connector and being contained in a housing which is secured to one face of the support element. U.S. Pat. No. 4,352,538, discloses an electrical connector which is float mounted in a cut out in a mounting panel by means of a latch member provided on the housing of the connector, having flanges for engaging opposite sides of the panel and a laterally projecting latch for engaging in a laterally projecting arm of the cut out into which protrudes a latching projection. There is disclosed in U.S. Pat. No. 5,017,151, an electrical connector comprising a pair of support posts from each of which a pair of helically configured, inwardly collapsible veins extend. The veins are tapered to define a minor cross sectional dimension less than the diameter of a mounting aperture in a panel, in which the connector is to be float mounted, and a major dimension which exceeds the diameter of the mounting aperture. The veins are spirally collapsed in response to ramping forces generated as they are urged into the mounting aperture in the panel and resiliently return to their undeflected condition to engage the panel. According to U.S. Pat. No. 4,909,748 an electrical connector has a housing with which are integrally formed annular spring members distributed about the periphery of the housing. The spring members are received in grooves in a pair of mating mounting panels so that the connector is float mounted to the panels. U.S. Pat. No. 4,664,456 discloses an electrical connector which is mounted in a cut out in a mounting panel by means of fasteners which extend through oversized holes in the panel so that the connector is float mounted thereto, elastomeric members extending about the fasteners. U.S. Pat. No. 4,812,133 discloses an electrical connector which is float mounted in a cut out in a mounting panel by means of a retaining clip having a pair of inwardly extending latching tabs each of which is provided with a downwardly extending hook. The retaining clip is snapped over the connector to releasably secure it to the panel. There is disclosed in U.S. Pat. No. 4,761,144, an electrical connector which is float mounted in a cut out in a mounting panel, by means of first and second transverse slots on opposed first and second sides of the insulating housing of the connector, into which slots portions of the panel edges bounding the cut out extend when the connector is mounted to the panel. The connector is capable only of limited longitudinal movement relative to the panel.

SUMMARY OF THE INVENTION

The present invention is intended to provide simplified and thus economical means by which an electrical connector can be mounted to float both rectilinearly and angularly in an oversized cut out in a mounting panel.

According to one aspect of the invention, there are provided in combination, an electrical connector and a mounting panel therefor, the mounting panel having a front face and a rear face and being formed with a cut out opening into both of said faces. The connector has a pair of coplanar flanges projecting in opposite directions therefrom and a forward part projecting from the flanges through the cut out and being undersized with respect thereto. The combination further comprises a pair of straps each having an inner face engaging a rear face of a respective one of the flanges and opposite ends secured to the rear face of the panel, the inner faces of the straps being spaced from the rear face of the panel substantially by the thickness of the flanges. Each flange is slideably received between the inner face of a respective one of the straps and a rear face of the panel;

whereby the connector can float in the cut out of the panel.

By virtue of the invention, the connector does not require complex parts for use in float mounting it to the panel, but merely pair of coplanar opposed flanges, the remaining parts for mounting the connector in the panel being a pair of simple straps, and fasteners, for example bolts and nuts, for securing the straps to the mounting panel. Since the flanges are slideable between the straps and the panel and are spaced from the ends of the straps which are secured to the panel, the connector is capable of both rectilinear and angular movement in the cut out, with respect to the panel.

Each strap, may consist for example of a rectilinear central leg having means at each end for mounting the strap to the panel and such means may comprise a mounting flange at each end of the central leg, the mounting flanges being offset from the central leg to provide the spacing between the strap and the rear face of the panel. The mounting means may, for example, be a tapped bore for receiving a bolt, or the mounting means may be in the form of a bolt shank for threadedly receiving a nut. Each strap may be in the form of a simple rectilinear strip having a bore proximate to each end, for receiving a cylindrical shank portion of a bolt for fastening the strap to the panel, or the bores in the strap maybe tapped for receiving a threaded end of such a bolt. The cylindrical shank portions of the bolts are dimensioned for standing the straps off from the panel.

According to further aspects of the invention, kits of parts comprise the straps, the mounting panel and the means for fastening the straps to the panel.

DETAILED DESCRIPTION OF THE EMBODIMENTS OF THE INVENTION

Figure 1:
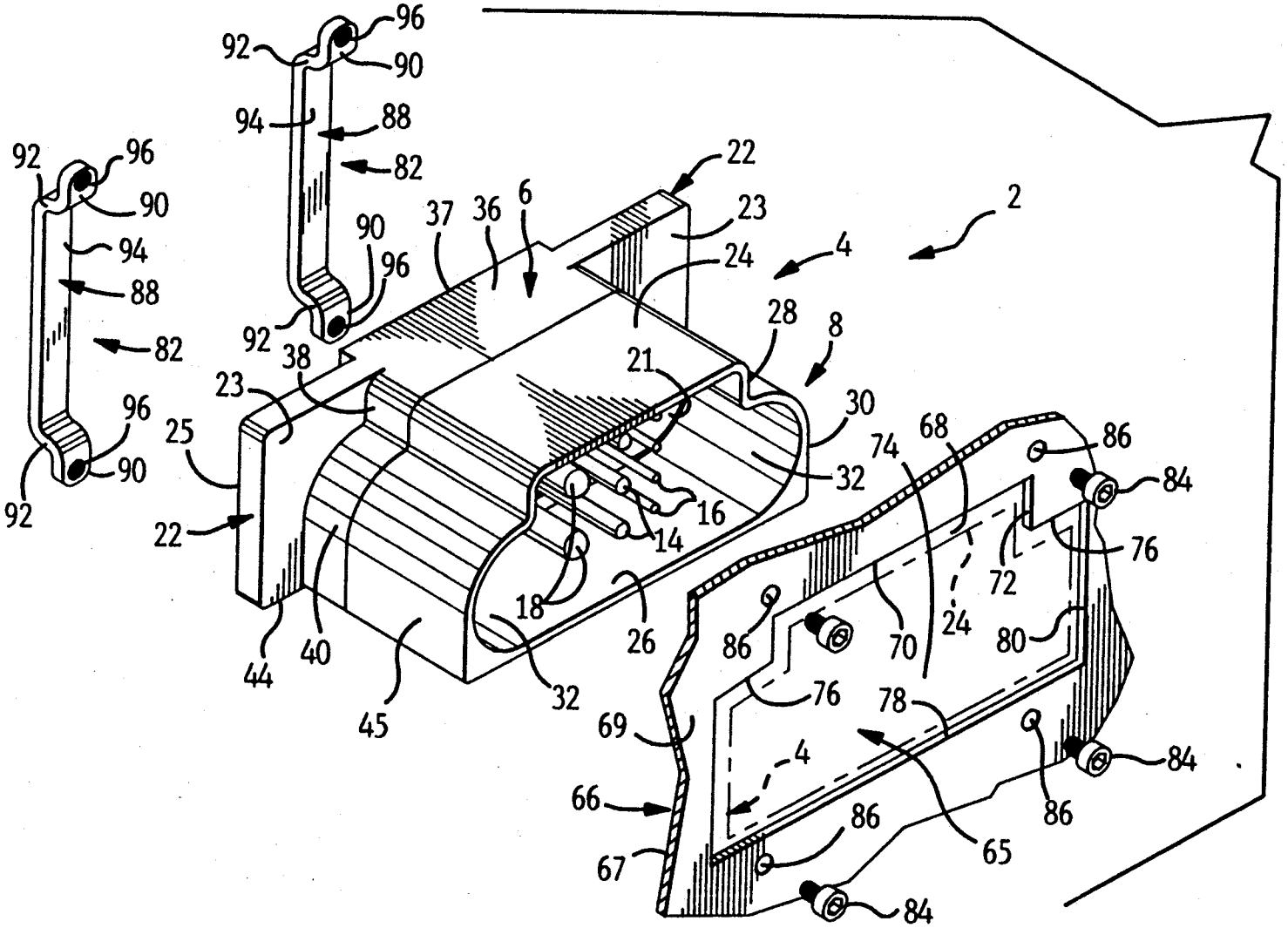
FIG. 1 is an exploded isometric view of an electrical connector mounted to float in a cut out in a mounting panel, according to a first embodiment of the invention.
Figure 2:
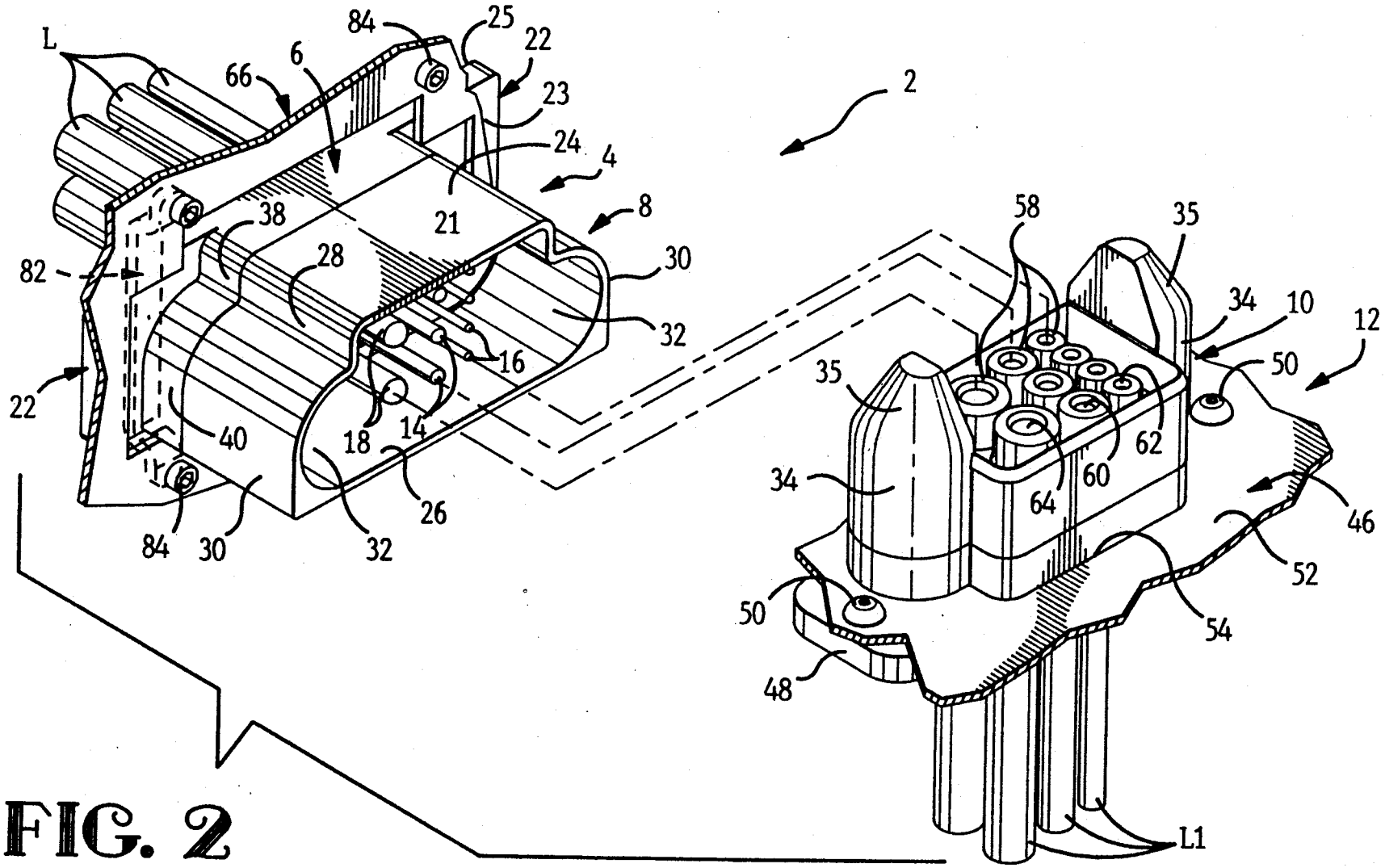
FIG. 2 is an isometric view showing the connector mounted to the panel and exploded from a mating plug connector.

The first, and preferred, embodiment of the invention will now be described with reference to FIGS. 1 to 7. An electrical connector 2 comprises an insulating housing 4, which may be a single piece or multiple part housing, having a rearward body 6 from which projects, forwardly, a hood 8 providing a receptacle for receiving a plug part 10 (FIG. 2) of a mating plug connector 12. Differently sized mating portions 14,16 and 18, respectively, of male electrical terminals (not otherwise shown) in terminal receiving cavities in the body 6, project from a mating face thereof into the hood 8 in an unsymmetrical array. There extend laterally from the body 6, opposed coplanar, identical rear flanges 22 having forward faces 23 and rear faces 25. The hood 8 has a top wall 24, a bottom wall 26, planar, parallel, upper side wall portions 28 depending normally of opposite lateral edges of the top wall 24 and thus being adjacent thereto, and arcuate, outwardly bowed lower side wall portions 30, of substantially semi circular cross sectional shape, each connecting the lower edge of a respective side wall portion 28 to the bottom wall 26. The side wall portions 30 define substantially semi circular keyways 32 for receiving keys 34 projecting forwardly from the plug connector 12 as shown in FIG. 2 and having tapered guide tips 35. The body 6 has an external top wall 36 coplanar with the top wall 24 of the hood 8, and a rear wall 37. Forwardly of the flanges 22, the body 6 has upper external, planar side wall portions 38 each of which is coplanar with a respective side wall portion 28 of the hood 8, lower, external arcuate, side wall portions 40, each of which is coaxial with a respective side wall portion 30 of the hood 8, and a bottom flange 42 depending from a bottom wall of the body 6 and extending between the side wall portions 40. The connector has a bottom edge 44. The terminals of the connector 2 are connected to the respective different gauge leads L which extend from the rear face of the body 6 as shown in FIG. 2. The leads are not shown in FIG. 1. The leads L are connected to circuitry of a module (not shown) for distributing electrical power to a computer (not shown), for example, contained in a rack mounted drawer (not shown).

The mating plug connector 12 comprises an insulating housing 46 having rear flanges 48 secured by fasteners 50 to a mounting panel 52, through a cut out 54 in which, the plug part 10 of the connector 12 and the keys 34 thereof project forwardly of the panel 52. The plug part 10 has a mating face 58 into which open cavities 60,62 and 64 respectively, arranged in an unsymmetrical array, for receiving respective ones of the mating portions 14,16 and 18 of the terminals of the connector 2, to mate with respective female mating portions of terminals in the cavities 60,62 and 64. These terminals are connected to respective different gauge leads L1, which are in turn connected to sources of electrical power for distribution by the module. The panel 52 is fixed, being the front panel of a casing mounted in the back behind the drawer containing the module.

The connector 2 is mounted to float, as described below, in a cut out 65 in a further panel 66 which is the back panel of the drawer. When the drawer is closed, the connectors 2 and 12 are mated so that the leads L are electrically connected to respective leads L1. When the drawer is opened, for example, for servicing the module therein, the connectors 2 and 12 are unmated so that the power supply to the module is cut off.

Since misalignment may occur between the back panel 66 of the drawer and the panel 52, as the drawer will normally be mounted for movement in the rack with some play, which is to be taken up by the guiding action of the tips 35 of the keys 34 as they engage in the keyways 32 of the connector 2, the connector 2 is mounted in the cut out 65 with a commensurate amount of float.

The cut out 65, which is laterally elongate, has a rectangular upper portion 68 with a top edge 70, and opposite parallel lateral edge portions 72 depending normally of the edge 70 and thus being adjacent thereto. The cut out 65 has a lower portion 74 having outward lateral edge portions 76 substantially parallel to edge 70, the inner ends of which are connected to the bottom ends of the edge portions 72, a rectilinear bottom edge 78, parallel with the top edge 70 and extending laterally therebeyond, and opposed substantially parallel lateral edge portions 80, connecting the outer ends of the edge portions 76 and the outer ends of the bottom edge 78.

As will best be apparent from FIGS. 1 to 4, the cut out 65 is dimensioned to receive the hood 8 and the body 6 of the housing 4 with substantial clearance, the upper rectilinear part of the hood and the body 6 being receivable in the upper rectilinear part 68 of the cut out 65 and the lower outwardly arcuate part of the hood 8 and the body 6 and the bottom flange 42 being receivable in the lower portion 74 of the cut out 65.

Figure 6:
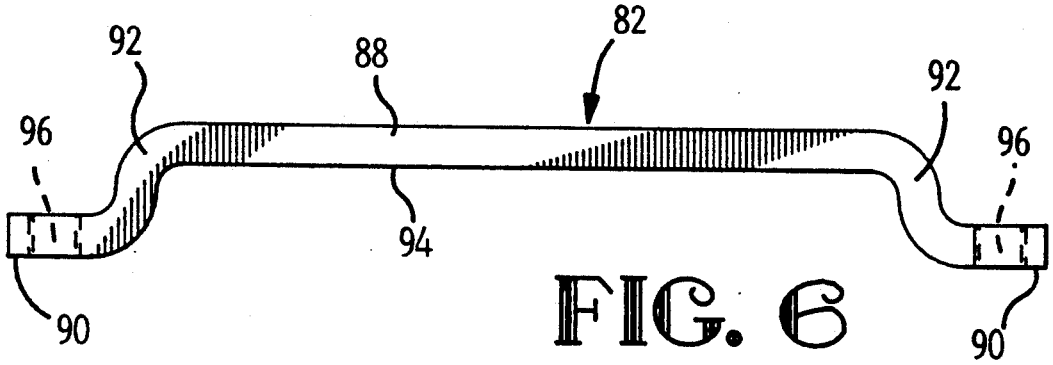
FIG. 6 is an enlarged side view of a strap for use in mounting the connector to the panel.
Figure 7:
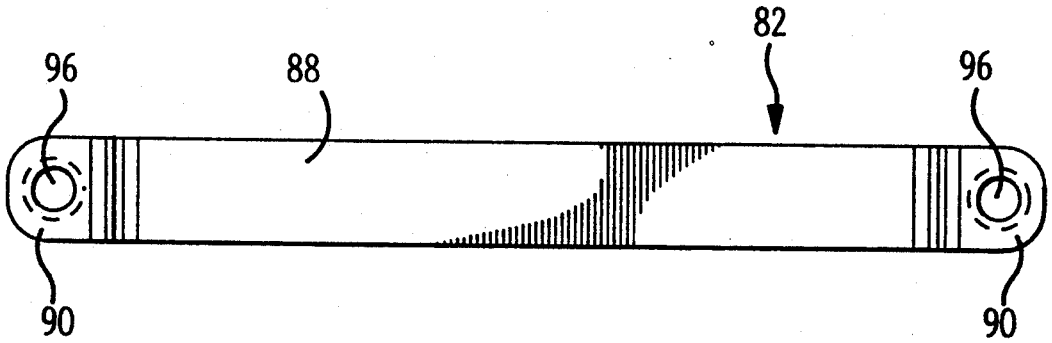
FIG. 7 is an enlarged plan view of the strap shown in FIG. 6.

There are provided for mounting the connector 4 to the panel 66, a pair of identical straps 82 and four bolts 84 for insertion through respective holes 86 in the panel 66. As best seen in FIGS. 6 and 7, each strap 82 has a rectilinear, flat central leg 88 and at each end thereof a mounting flange 90 parallel with the leg 88 and being connected thereto by way of a joggle 92 so that each flange 90 is offset from the inner surface 94 of the leg 88 in the same direction by substantially the thickness of the flanges 22. Each flange 90 has a tapped, through opening 96 for receiving the shank of a respective bolt 84.

Figure 3:
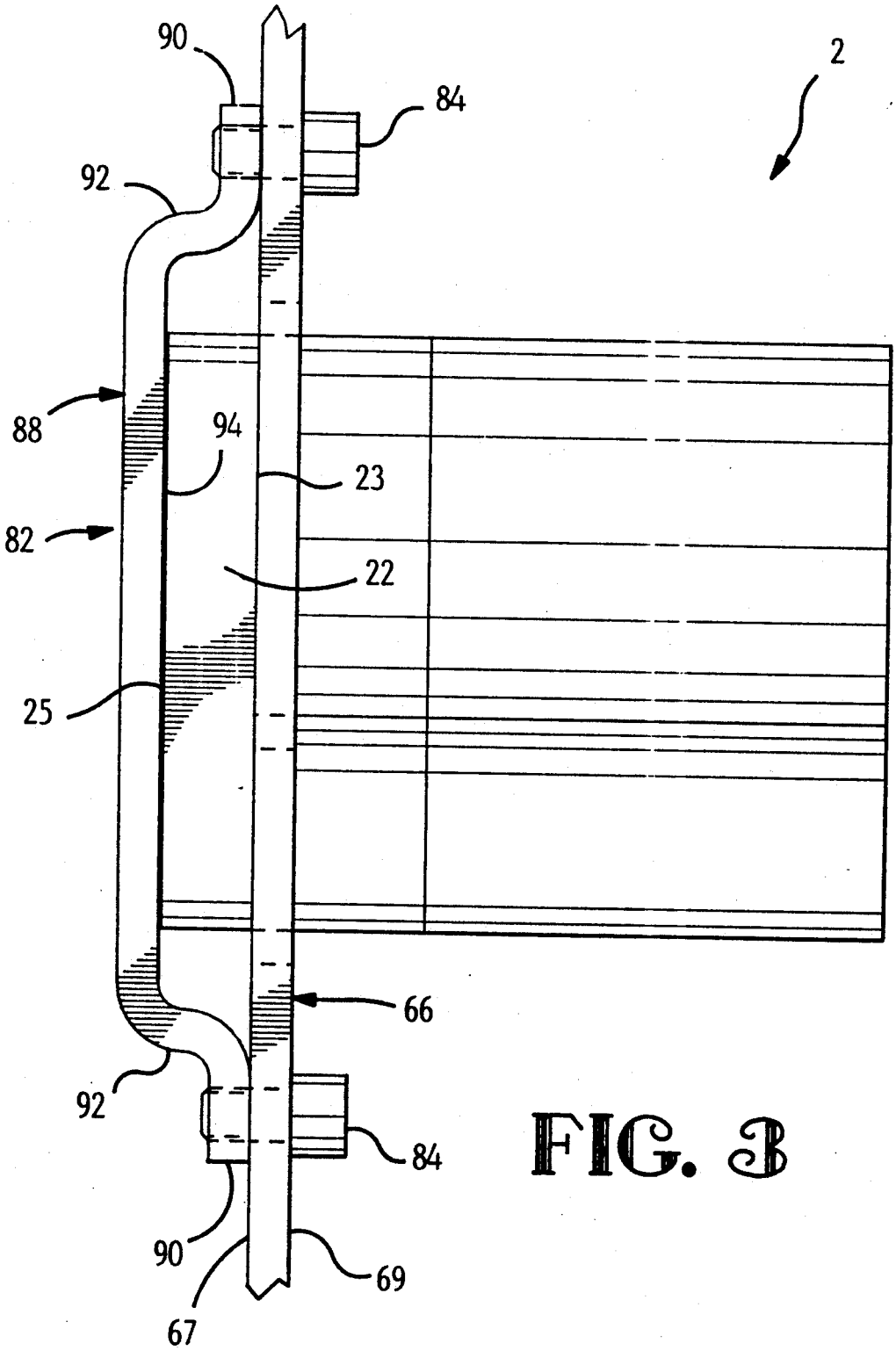
FIG. 3 is a side view of the connector, when mounted in the cut out.

In order to mount the connector 2 to the panel 66, a hood 8 is inserted through the cut out 65 from the rear of the panel 66, the body 6 of the connector 2 being passed through the cut out 65 until the front faces 23 of the flanges 22 of the connector 2 abut the rear face 67 of the panel 66 as shown in FIG. 3. Each strap 82 is then applied to the panel with each tapped opening 96 of the strap 82 in alignment with a respective opposite pair of holes 86 in the panel 66, the inner surface 94 of the leg 88 of the strap 82 abutting the rear face 25 of a respective flange 22 of the connector 2. The shank of each bolt 84 is inserted through a respective hole 86, from the front face 69 of the panel 66 and is screwed into the tapped opening 96 in alignment with the hole 86, until the head of the bolt 84 abuts the front face 69 of the panel 66.

Figure 4:
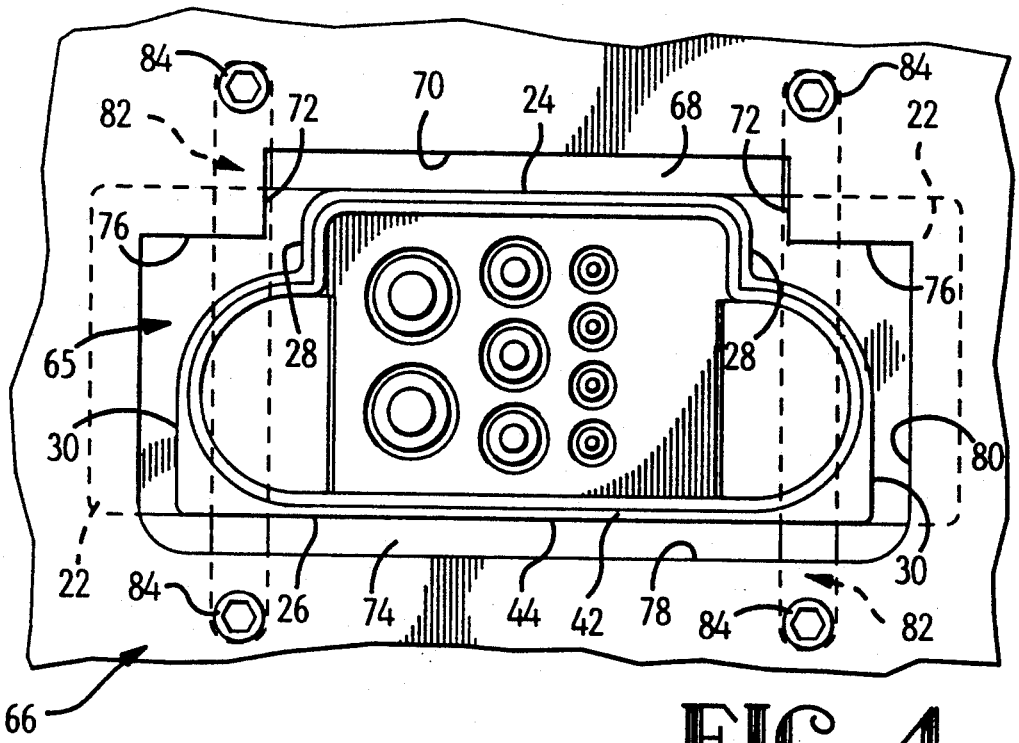
FIG. 4 is a diagrammatic front view of the connector mounted to the panel and being centered in the cut out.
Figure 5:
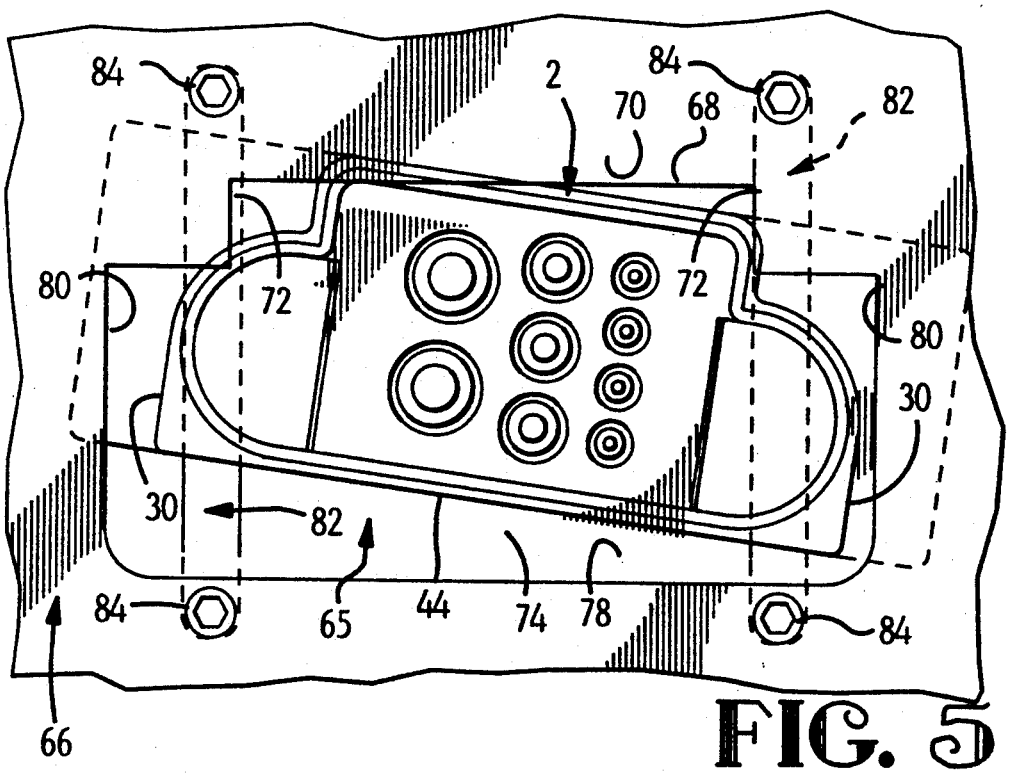
FIG. 5 is a similar view to that of FIG. 4 but showing the connector in the cut out.

The joggles 92 and the legs 88 of the straps 82 are so dimensioned, and the holes of the opposed pairs of holes 86 in the panel 66 are so spaced that the flanges 22 and slidably received between surfaces 94 of the straps and the rear face 67 of the panel 66, whereby the connector 2 can float in the cut out 65 to the extent of the oversize of the cut out 65 with respect to the cross sectional area of the connector 2. The connector 2 can accordingly float in the cut out 65, from a position in which it is centered in the cut out 65 as shown in FIG. 4, to a skewed position in the cut out 65. An example of such a skewed position of a connector 2 is shown in FIG. 5. Accordingly, the connector 2, can align itself with the connector 12 as the guide tips 35 of the keys 34 of the connector 12 engage in the keyways 32 of the connector 2. The bottom edge 44 of the flange 42 of the connector 2 can engage against the bottom edge 78 of the cut out 65 and the lateral edges 45 of the flange 42 can engage with the respect edge portions 80 of the cut out 65.

Figure 8:
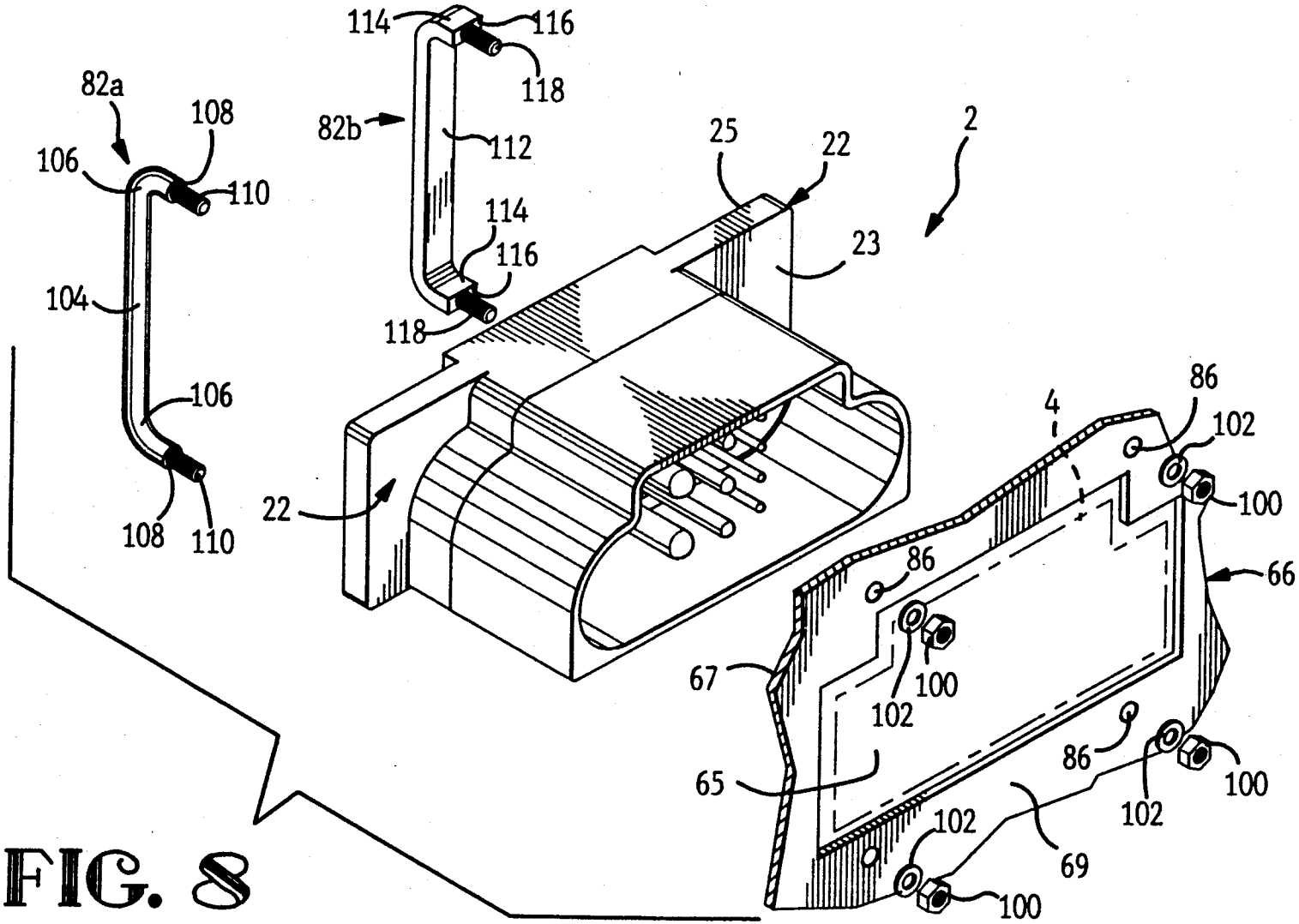
FIG. 8 is a similar view to that of FIG. 1 but illustrating the variants of a second embodiment of the invention.
Figure 9:
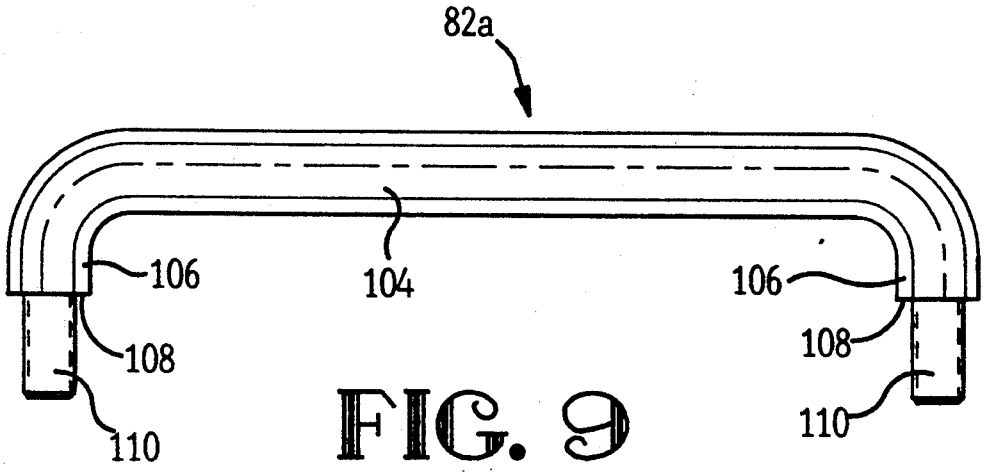
FIG. 9 is an enlarged view of a strap for mounting the connector of FIG. 8 to the panel.
Figure 10:
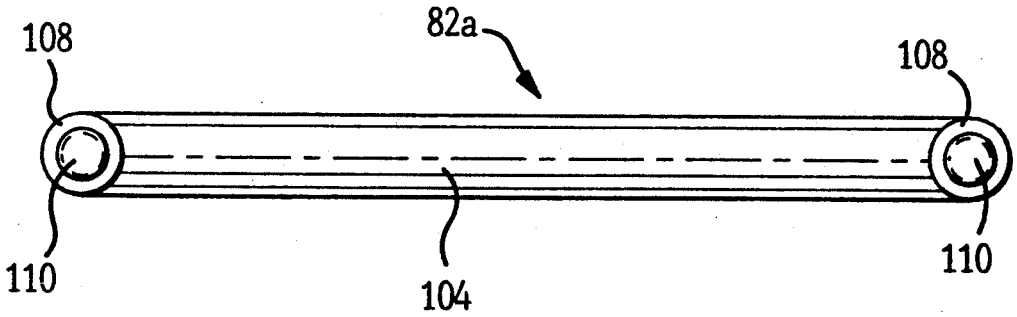
FIG. 10 is a plan view of the strap of FIG. 9.

The second embodiment of the invention will now be described with reference to FIGS. 8 to 10. This embodiment of the connector 2 the panel 66 and its cut out 65 are identical with those described above. For mounting the connector 2 to the panel 66, either of straps **82*a* or 82*b* may be used in cooperation with nuts 100 and washers 102. Each strap 82*a* (only one of which is shown) is of circular cross section and comprises a rectilinear leg 104 and end portions 106 projecting at right angles from opposite ends of the leg 104 and in the same direction. Each end portion 106 terminates in a peripheral shoulder 108 from the center of which projects a screw threaded bolt shank 110. Each strap 82*b* comprises a flat leg 112 and end portions 114 projecting at right angles from opposite ends of the leg 112 and in the same direction. Each end portion 114 terminates in a shoulder 116 from which projects a threaded bolt shank 118**.

The connector 2 is mounted to the panel 66 by inserting the connector 2 through the cut out 65 from the rear of the panel 66, until the front faces 23 of the flanges 22 abut the rear face 67 of the panel, as in the first embodiment. The shank 110 of each strap **82*a* or the shank 118 of each strap 82*b* is inserted through a respective hole 86 in the panel 66 until the shoulders 108 or 116 as the case may be, of the strap 82*a* or 82*b* abuts the rear face 67 of the panel 66. A respective washer 102 is then pushed over the respective screw threaded shank 110 or 118 and a respective nut 100 is threaded on to the shank and is tightened to secure the straps to the panel. The end portions 106 and 114 are so dimensioned that the straps are stood off from the panel, by substantially the thickness of the flanges 22 so that the connector 2 is free to float in the cut out 65** in the manner described above with respect to the first embodiment.

Figure 11:
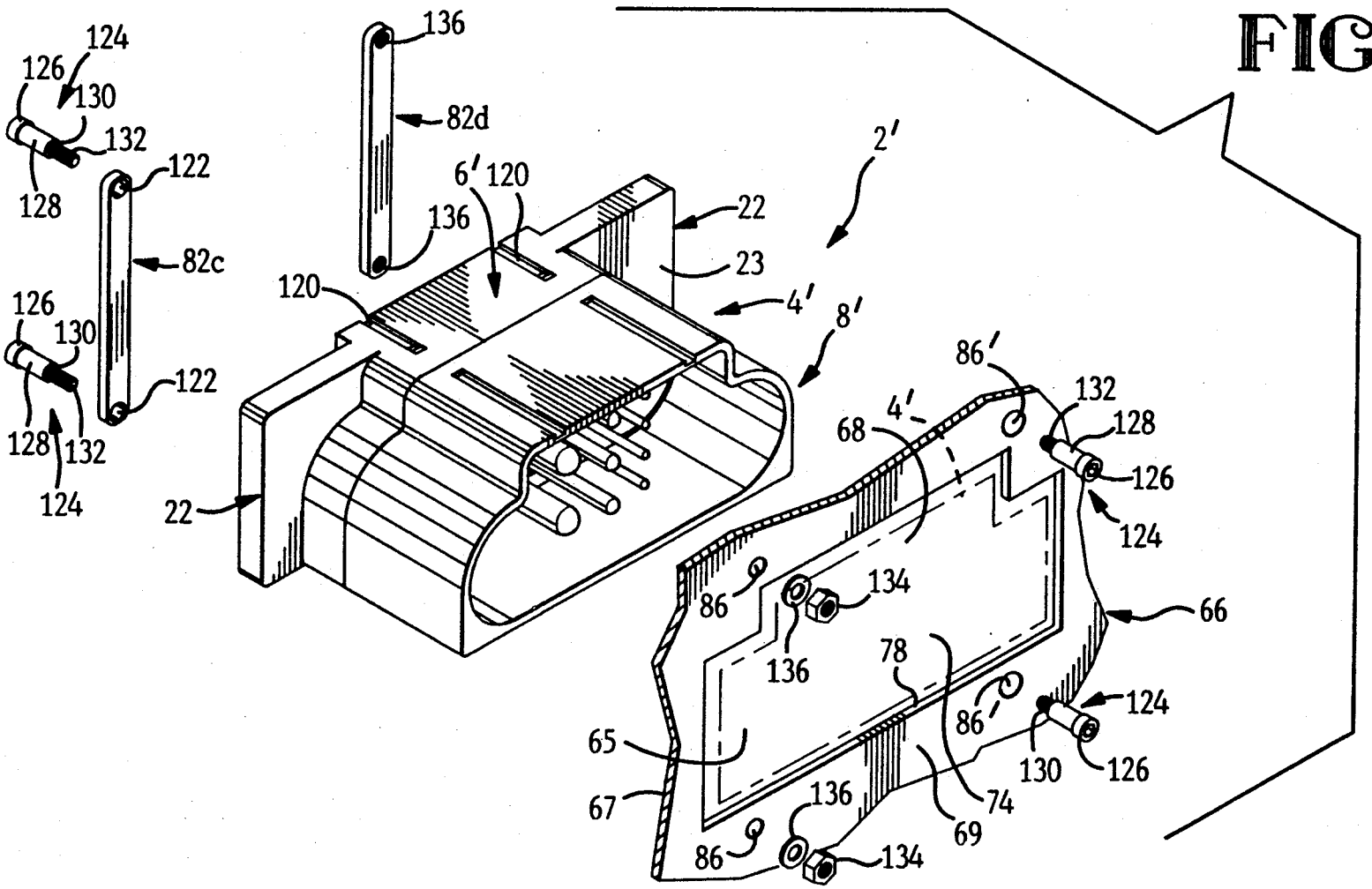
FIG. 11 is a view similar to that of FIGS. 1 and 8 but illustrating two variants of a third embodiment of the invention.

The third embodiment of the invention will now be described with reference to FIG. 11. In this embodiment, the connector 2' is the same as the connector 2 expecting that the housing 4' is made in two parts, namely a body part 6' and a hood part 8', the hood part 8' being secured to the body 6' by means of latches engaging in slots 120 in the body 6' in known manner. The panel 66 and the cut out 65 are the same as in the first two embodiments although the holes 86' are larger according to one of two variants of the embodiment. The first variant employs a flat elongate, rectilinear strap **82*c* formed with a circular cross section, smooth bore 122 proximate to each of its ends. According to the first variant, bolts 124, each having a head 126 from which projects a smooth, circular shank portion 128 dimensioned for insertion through a respective bore 122 and terminating in a shoulder 130 from which there projects a screw threaded bolt portion 132, are provided for cooperation with nuts 134 and washers 136. In order to mount the connector 2' in the cut out 65, the connector 2' is inserted thereinto until the flanges 22 abut the rear face 67 of the panel 66, in the manner described above. Each bolt 124 is inserted from the rear, through a respective bore 122 in a respective strap 82*c* until the head 126 of the bolt 124 abuts the rear face of the strap 82*c*. The bolt portion 132 of each bolt 124 is threaded through a respective hole 86 until the straps 82*c* abut against the backs of the flanges 22, and the washers 136 are threaded on to the bolt portions 132 and the bolts 134 are screwed down thereon so that the connector 2' is secured in the cut out in the panel 66. Since the length of each shank portion 128 is substantially equal to the thickness of the flanges 22 and that of the panel 66, the connector 2' can float in the cut out 65** in the manner described with reference to the first and second embodiments of the invention.

According to the second variant, the straps **82*d* are the same as the straps 82*c* expecting that the bores 136 therein are tapped and are dimensioned to receive the threaded shank portions 132 of the bolt 124, the holes 86' in the panel 66 being dimensioned to receive the smooth shank portions 128 of the bolts 124. Typically this would require that holes 86' be of a slightly larger diameter than holes 86. In this case, as shown in the left hand part of FIG. 11, the bolts 124 are inserted through the holes 86 from the front face 69 of the panel 66 and the screw threaded shank portions 132 of the bolts 124 are screwed into the bores 136 of the straps 82*d* to urge them against the backs of the flanges 22**.

While the preferred embodiment has been described with respect to a float mount connector, it is recognized that the connector and mounting brackets disclosed herein can be used to secure or mount a connector to a panel in a manner to not provide float mount. Such a mounting would have a panel cut out that is substantially the size of the connector, or brackets that have end portions shorter than the thickness of the flanges on the connector housing such that the connector is clamped to the panel in a fixed position.

Furthermore, while the preferred embodiment discloses securing the connector tot he panel using brackets with threaded portions, or with bolts and nuts, other securing means are considered within the scope of the invention. For example the connector housing could have resilient structure that would provide a snap-in retention or brackets securable by other means such as snap in retention or clinching.

Advantage of the embodiments described above, is that for mounting the connector to float in the cut out in the panel, the only parts needed are the straps which are of very simple configuration and nuts and bolts, or bolts only.

What is claimed is:

1. An electrical connector for mounting on a panel, the panel having a front face and a rear face and being formed with a cut out opening into both of said faces, the connector comprising:

a pair of coplanar flanges projecting in opposite directions, and a forward part projecting from the flanges adapted to extend through the cut out and being undersized in respect thereto;

a pair separate straps each having an inner face engaging a rear face of a respective one of the flanges and opposite ends secured to the rear face of the panel, the inner faces of the straps being spaced from the rear face of the panel substantially by the thickness of the flanges and each flange being slideably received between the inner face of a respective one of the straps and the rear face of the panel, whereby the connector can float in the cut out of the panel.

2. An electrical connector as recited in claim 1, wherein the cut out is larger than the connector in the plane of the panel to provide a float mount for the connector.

3. An electrical connector as recited in claim 1, wherein each strap has a rectilinear central leg and at each end of the leg, a mounting flange parallel with the leg and a joggle connecting the mounting flange to the central leg, the mounting flange being releasably secured to the panel, the joggle offsetting the central leg from the rear face of the panel.

4. An electrical connector as recited in claim 1, wherein each strap has a central rectilinear leg and end portions projecting at right angles from opposite ends of the central leg in the same direction, with each end portion securable to the panel.

5. An electrical connector as recited in claim 4, wherein each end portion terminates in a shoulder, a bolt shank projecting from the shoulder through a respective hole in the panel and receiving a nut securing the shoulder against the rear face of the panel.

6. An electrical connector as recited in claim 1, wherein each strap is flat, elongate and rectilinear and is formed with a through bore proximate to each end of the strap, each bore receiving a shank portion of a bolt having a head engaging a rear face of the strap, the shank portion terminating in a shoulder from which projects a bolt shank extending through a respective hole in the panel and receiving a nut securing the shoulder against the rear face of the panel.

7. An electrical connector as recited in claim 1, wherein each strap is flat, elongate and rectilinear and is formed with a tapped bore proximate to each end of the strap, a bolt having a head, a shank portion projecting from the head and terminating in a shoulder from which projects a screw threaded shank, being provided in each tapped bore, the head of each bolt engaging the front face of the panel and the shank portion of the bolt extending through a respective hole in the panel and the screw threaded bolt shank of the bolt being threadedly received in a respective one of the tapped bores of the straps, said shank portions being dimensioned to off set the straps from the rear face of the panel substantially by the thickness of said flanges.

8. An electrical connector as recited in claim 1, wherein the straps have end portions projecting towards the panel, for spacing the straps from the rear face of the panel.

9. An electrical connector as recited in claim 1, wherein the straps are spaced from the rear face of the panel by means of bolts securing the opposite ends of the straps to the panel.

10. An electrical connector as recited in claim 1, wherein the connector comprises an insulating housing having a rearward body from which the flanges project laterally and a hood projecting forwardly from the body, the body being received in the cut out, the body having a planar top wall, planar upper side wall portions depending from opposite ends of the top wall at right angles thereto, outwardly bowed, lower side wall portions each extending from the lower edge of a respective one of the upper side wall portions, and a bottom flange parallel with the laterally projecting flanges and being connected thereto forwardly thereof, the cut out having a rectangular upper portion for receiving the top wall and the upper side wall portions of the housing, a lower portion for receiving the lower side wall portions of the housing and a rectilinear bottom edge for engagement by a rectilinear bottom edge of the bottom flange of the housing.

11. The combination claimed in claim 1, wherein the cut out is dimensioned to allow for both rectilinear and angular movement of the connector in the cut out.

* * * * *

UNITED STATES PATENT AND TRADEMARK OFFICE

CERTIFICATE OF CORRECTION

PATENT NO. : 5,205,755
DATED : April 27, 1993
INVENTOR(S) : George H. Douty et al.

It is certified that error appears in the above-indentified patent and that said Letters Patent is hereby corrected as shown below:

Claim 1, Column 7, Line 1, insert --of-- after the word "pair".

Signed and Sealed this

Ninth Day of August, 199

*Attest:*

Bruce Lehman

BRUCE LEHMAN

*Attesting Officer*

*Commissioner of Patents and Trademarks*